US009341427B2

(12) United States Patent
Bricko et al.

(10) Patent No.: US 9,341,427 B2
(45) Date of Patent: May 17, 2016

(54) PORTABLE SHOOTING BENCH AND UTILITY TABLE

(71) Applicants: Benjamin A Bricko, Faribault, MN (US); Thomas K Bricko, Northfield, MN (US)

(72) Inventors: Benjamin A Bricko, Faribault, MN (US); Thomas K Bricko, Northfield, MN (US)

( * ) Notice: Subject to any disclaimer, the term of this patent is extended or adjusted under 35 U.S.C. 154(b) by 0 days.

(21) Appl. No.: 14/832,820

(22) Filed: Aug. 21, 2015

(65) Prior Publication Data

US 2016/0054091 A1 Feb. 25, 2016

Related U.S. Application Data

(60) Provisional application No. 62/040,113, filed on Aug. 21, 2014.

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/12; F41A 23/14; F41A 23/10; F41A 23/18; F41A 23/08; F41A 23/04; F41A 23/06
USPC ..... 42/94
See application file for complete search history.

(56) References Cited

U.S. PATENT DOCUMENTS 1,560,563 A * 11/1925 Gorton ..... F41A 23/12 89/40.06
1,746,364 A * 2/1930 Schuler ..... F41A 23/12 89/40.06

(Continued)

*Primary Examiner* — Joshua Freeman
(74) *Attorney, Agent, or Firm* — Greg N. Geiser; Geiser Law, PLLC

(57) ABSTRACT

A portable shooting bench and utility table. In the shooting-bench embodiment, a tabletop is isosceles-triangle-shaped for ambidextrous functionality. In the utility-table embodiment, the tabletop is preferably round but can be any shape suitable for general use. The shooting-bench embodiment preferably includes a height-adjustable seat. A plurality of ratcheting leg couplers are rotatably attached to a support base and radiate outward from the support base. A proximate end of a leg attaches in ratcheting fashion to each ratcheting leg coupler, allowing adjustment of an angle of declination of each leg. The ratcheting leg couplers rotate about the support base, allowing radial positioning of the legs for optimum stability under various terrain conditions. The shooting bench or utility table can be converted from a deployed mode to a folded mode, in which shoulder straps can be affixed to the tabletop allowing transport of the shooting bench or utility table backpack-style.

11 Claims, 6 Drawing Sheets

(56) References Cited

U.S. PATENT DOCUMENTS 3,225,656 A * 12/1965 Flaherty ..... F41A 23/16 42/94
4,345,398 A * 8/1982 Pickett ..... F41A 23/06 42/94
4,854,066 A * 8/1989 Canterbury, Sr. ..... F41A 23/04 42/94
4,937,965 A * 7/1990 Narvaez ..... F41A 23/02 42/94
5,060,410 A * 10/1991 Mueller ..... F16M 11/00 42/94
5,149,900 A * 9/1992 Buck ..... F41A 23/16 248/122.1
5,414,949 A * 5/1995 Peebles ..... F41A 23/16 42/94
5,551,655 A * 9/1996 Berger ..... F16M 11/32 248/168
5,715,625 A * 2/1998 West, III ..... F41A 23/16 42/94
6,044,747 A * 4/2000 Felts ..... F41A 23/16 42/94
6,058,641 A * 5/2000 Vecqueray ..... F41A 23/12 248/425
6,895,709 B1 * 5/2005 Krien ..... A47B 83/02 42/94
6,935,064 B1 * 8/2005 Thompson ..... F41A 23/34 248/176.1
7,152,358 B1 * 12/2006 LeAnna ..... F41A 23/02 297/170
7,549,247 B1 * 6/2009 Reese ..... F41A 23/16 42/94
D705,387 S * 5/2014 Nelson ..... D22/199
D709,295 S * 7/2014 Winebrenner ..... D6/338
2005/0188597 A1 * 9/2005 Keng ..... F41A 23/08 42/94
2007/0169391 A1 * 7/2007 Carpenter ..... F41A 23/14 42/94
2008/0163534 A1 * 7/2008 Lombardi ..... F41A 23/16 42/94
2009/0113779 A1 * 5/2009 Shipman ..... F16M 11/10 42/94
2013/0061508 A1 * 3/2013 Nelson ..... F41A 23/10 42/94
2016/0003571 A1 * 1/2016 Kleinfelder ..... F41A 23/16 42/94

* cited by examiner

PORTABLE SHOOTING BENCH AND UTILITY TABLE

CROSS REFERENCE TO RELATED APPLICATIONS

This application claims priority to U.S. Provisional Patent Application No. 62/040,113 filed 21 Aug. 2014 to the above named inventors, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

BACKGROUND OF THE INVENTION

Shooting benches are commonly intended to provide a shooter with a place to sit and a surface on which the shooter may support his or her arms when shouldering a firearm (generally a rifle) to aim at a target. Shooting benches at many formal target ranges are often relatively permanent structures not intended to be transported. Or shooting benches that are not intended to be a permanent structures are often quite large and unwieldy, making transport of the shooting bench difficult at best.

A portable shooting bench is desirable for shooters wishing to engage in shooting with the support of a bench rest in a variety of different locations. In addition to being compact and relatively lightweight, it is preferable that the portable shooting bench can be used by either a left-handed shooter or a right-handed shooter. Further, it is preferable that the shooting bench may be adjusted to accommodate shooters having different body sizes. It is also preferable that legs of the shooting bench can be quickly and easily adjusted both vertically and horizontally to provide level and solid support for the shooting bench in differing terrain conditions found at various locations for shooting.

SUMMARY OF THE INVENTION

A portable shooting bench embodying the principles of the invention is lightweight and compact. Further, the portable shooting bench can be converted from a deployed mode to a folded mode in which, preferably, shoulder straps can be affixed to the shooting bench in the folded mode to allow a user to transport the shooting bench backpack-style.

A tabletop of the shooting bench is preferably the rough shape of an isosceles triangle, which allows the tabletop, when the shooting bench is in the deployed mode, to provide support for either a left-handed shooter or a right-handed shooter. A seat on the shooting bench can adjusted up and down to accommodate shooters of different size.

A plurality of ratcheting leg couplers are rotatably attached to a support base of the shooting bench and radiate outward from the support base. A proximate end of one of a plurality of legs attaches in ratcheting fashion to one of the plurality of ratcheting leg couplers, allowing the user to independently adjust an angle of declination of each of the legs. The ratcheting leg couplers freely rotate about the support base, which allows the user to radially position the legs for optimum stability of the shooting bench under varying terrain conditions.

In alternative embodiment of the present invention, the portable shooting bench becomes a portable utility table by substituting a utility tabletop for the shooting-bench tabletop. The utility tabletop has a size and structure suitable for more standard uses of a table often encountered during activities such as camping, picnicking, and tailgating. In a preferred embodiment, the utility tabletop is round in shape, but other shapes including rectangles, triangles, and ovals are included within the scope of the invention. A means for folding or temporarily disassembling the utility tabletop, which allow the utility tabletop to be less bulky when the utility table is in a folded mode, are included within the scope of the invention. Shoulder straps also can be affixed to the utility tabletop to allow the utility table to be transported in backpack mode by the user.

These and other features of the present invention will be more readily and fully understood by reference to the accompanying illustrations and the detailed description that follow

BRIEF DESCRIPTION OF THE ILLUSTRATIONS

The accompanying illustrations are included to provide a further understanding of the present invention and are incorporated in and constitute a part of this specification. The illustrations depict exemplary embodiments of the present invention and together with the description serve to further explain the principles of the invention. Other aspects of the invention and the advantages of the invention will be better appreciated as they become better understood by reference to the Detailed Description when considered in conjunction with accompanying illustrations, and wherein.

DETAILED DESCRIPTION

To provide an understanding of the basic principles of the invention, reference is made to the embodiments shown in the illustrations, and specific terms will be employed to describe the same. It should be understood, however, that no limitation of the scope of the invention is thereby intended. Instead, the invention includes any and all such alterations and improvements of the illustrated device that would normally occur to one skilled in the art to which the invention relates.

Figure 1:
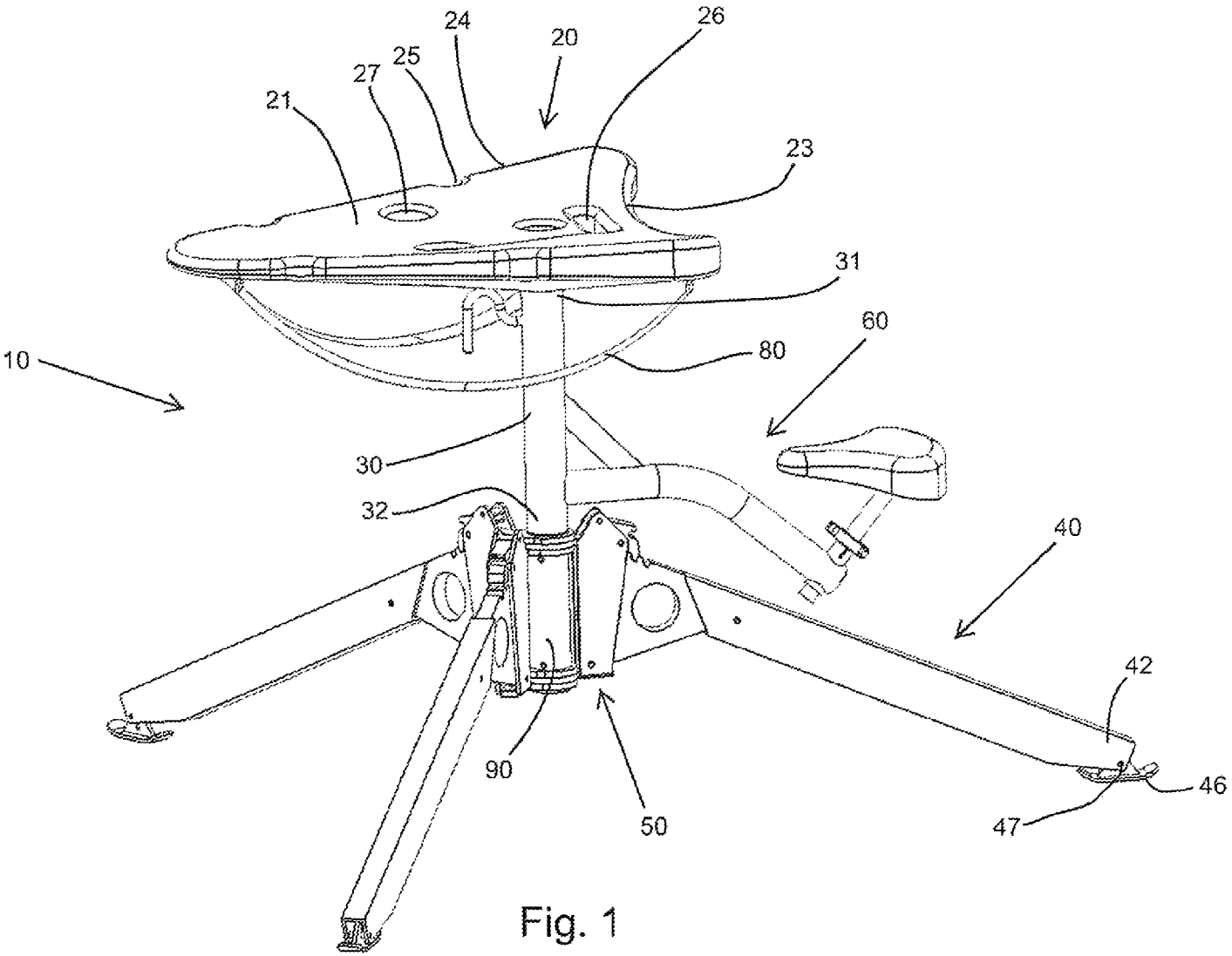
FIG. 1 is a perspective view of one embodiment of the portable shooting bench in the deployed mode.

Reference should now be made to FIG. 1, in particular, in which an embodiment of a portable shooting bench 10 is shown in a deployed mode, according to the present invention. The shooting bench 10 is comprised of a shooting-bench tabletop 20 removably affixed atop an upper end 31 of a support post 30. A seat assembly 60 is perpendicularly attached to the support post 30. A lower end 32 of the support post 30 is rotatably affixed atop a support base 90. A plurality of ratcheting leg couplers 50 are rotatably attached to the support base 90 and radiate outward from the support base 90. A leg 40 is attached to each of the ratcheting leg couplers 50. A foot 46 is pivotally mounted to a distal end 42 of each leg 40 by means of a pin 47.

The shooting-bench tabletop 20 is preferably the approximate shape of an isosceles triangle, allowing the shooting bench 10 to accommodate a user who is either left-handed or right-handed. A rear edge 23 of the shooting-bench tabletop 20, forming a base of the approximate isosceles triangle, is preferably curved inward to more comfortably receive a torso of the user leaning forward to shoot from the shooting bench 10. Each of a pair of lateral edges 24 of the shooting-bench tabletop 20, forming triangle legs of the approximate isosceles triangle, preferably has at least one curved indentation 25, the curved indentation 25 sized and structured to securely receive a barrel of a firearm, if the user wishes to place a butt of the firearm on a ground surface and lean the firearm against one of the pair of lateral edges 24 for temporary support.

The shooting-bench tabletop 20 also includes an upper surface 21, the upper surface 21 preferably having a concave shape to more comfortably fit against a back of the user, if the user is carrying the shooting bench 10 in backpack mode (described below). The upper surface 21 also optionally includes at least one cup-holder indentation 27 shaped to hold beverages, ammunition, tools, and the like.

A preferred embodiment of the shooting-bench tabletop 20 further includes a carrying hole 26, the carrying hole 26 passing through the shooting-bench tabletop 20 and preferably having an oblong shape sized to receive four fingers on one hand of the user. The carrying hole 20 is preferably placed proximate either the rear edge 23 or one of the pair of lateral edges 24 of the shooting-bench tabletop 20.

A preferred embodiment of the shooting bench also includes a pair of shoulder straps 80. When the shooting bench 10 is in the deployed mode, the shoulder straps 80 are preferably affixed to a lower surface 22 of the shooting-bench tabletop 20, so as not interfere with the activity of the user when using the shooting bench 10 to shoot.

Figure 2:
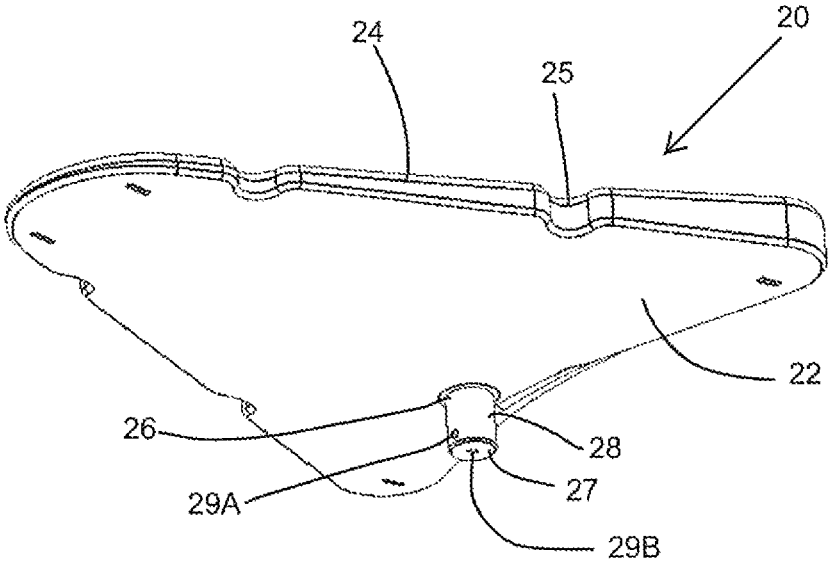
FIG. 2 is a detailed perspective view from below of one embodiment the shooting-bench tabletop.

As shown in FIG. 2, an upper end 26 of a table post 28 is affixed to the lower surface 22 of the shooting-bench tabletop 20, the table post 28 having a cylindrical structure. A lower end 27 of the table post 28 protrudes perpendicularly away from the lower surface 22 of the shooting-bench tabletop 20. The table post 28 also includes a deployed-position clamp-rod threaded hole 29A in a curved side of the cylindrical structure, the deployed-position clamp-rod threaded hole 29A having female threads sized and structured to receive a male threaded end 71 of a clamp rod 70 (more fully described below). The table post 28 further includes a folded-position clamp-rod threaded hole 29B near a center point of a base of the cylindrical structure of the table post 28, the folded-position clamp-rod threaded hole 29B having female threads sized and structured to receive the male threaded end 71 of the clamp rod 70.

Figure 3:
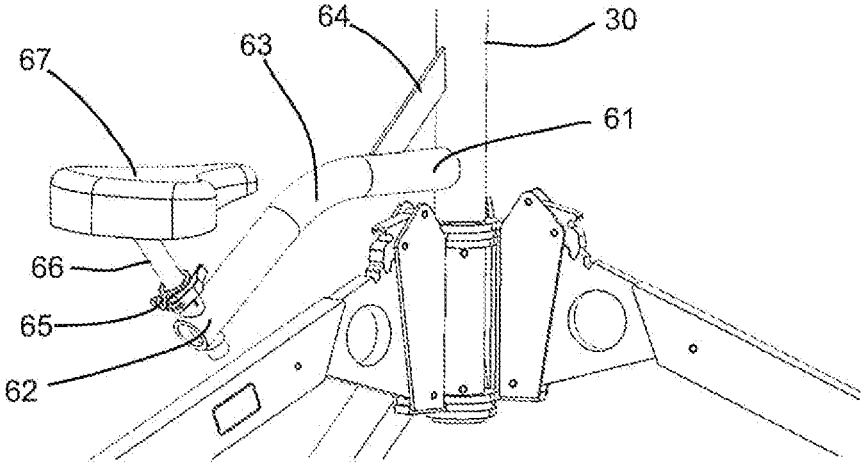
FIG. 3 is a detailed perspective view, focusing on the seat assembly, of one embodiment of the seat assembly.

As can be seen most clearly in FIG. 3, the seat assembly 60 includes an arm 63, the arm having a first end 61 and a second end 62. The first end 61 is attached to the support post 30 and the second end 62 protrudes away from the support post 30. In a preferred embodiment, the arm 63 is bent slightly to improve the positioning of the user when shooting. The seat assembly 60 preferably includes at least one support brace 64 connecting the arm 63 with the support post 30 to improve the structural integrity of the seat assembly 60. A clamping mechanism 65 is positioned at the second end 62 of the arm 63, the clamping mechanism 65 having a size and structure to slidably receive a seat post 66. A seat 67 is affixed atop the seat post 66. The user can alter the height of the seat 67 by slidably adjusting the position of the seat post 66 within the clamping mechanism 65.

Figure 6:
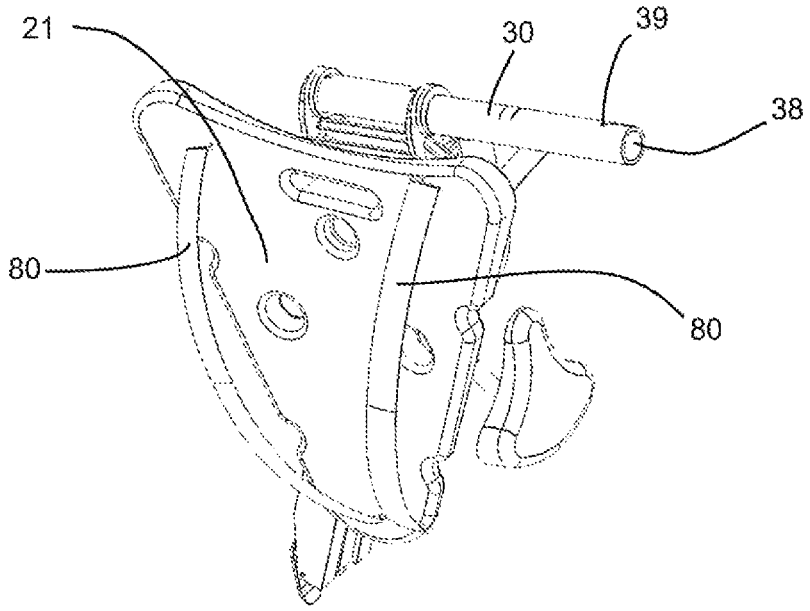
FIG. 6 is an alternative perspective view of one embodiment of the shooting bench in the folded mode.

As can be seen most clearly in FIG. 6, the upper end 31 of the support post 30 includes a support-post aperture 38, the support-post aperture 38 having a size and structure to securely receive the table post 28 when the user inserts the table post 28 into the support-post aperture 38. The support post 30 further includes a support-post clamp-rod hole 39, the support-post clamp-rod hole 39 is sized slightly larger than the male threaded end 71 of the clamp rod 70.

Figure 4:
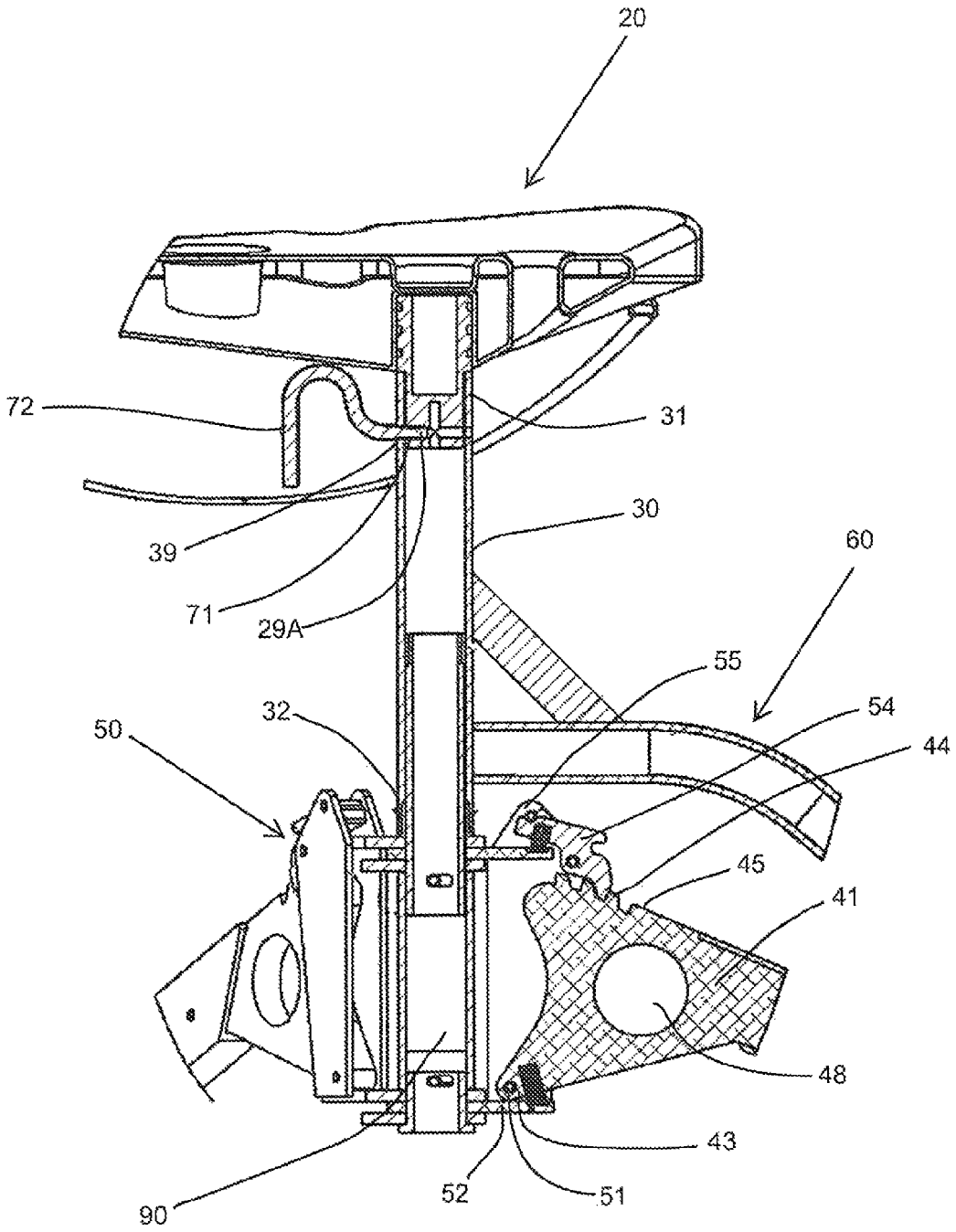
FIG. 4 is a partial cut-away view of one embodiment of the shooting bench.

As can be seen most clearly in FIG. 4, the support-post clamp-rod hole 39 is positioned on the upper end 31 of the support post 30 so that the support-post clamp-rod hole 39 can be aligned by the user with the deployed-position clamp-rod threaded hole 29A, after the user inserts the table post 28 into the support-post aperture 38. The user can firmly, yet temporarily, attach the shooting-bench tabletop 20 to the support post 30 by aligning the support-post clamp-rod hole 39 with the deployed-position clamp-rod threaded hole 29A. The user then grasps a clamp-rod handle 72 attached to the clamp rod 70, opposite the male threaded end 71, and screws the male threaded 71 end of the clamp rod 70 into the deployed-position clamp-rod threaded hole 29A.

The lower end 32 of the support post 30 is rotatably attached atop the support base 90. Thus, in the deployed mode, the user may rotate the shooting-bench tabletop 20, support post 30, and seat assembly 60 as a unit about an axis formed by a length of the support post 30. Optionally, a means (not shown) for temporarily preventing the rotation of the support post 30 is included within the scope of the present invention.

The plurality of ratcheting leg couplers 50 are rotatably attached to the support base 90 and radiate outward from the support base 90. The free rotation of the ratcheting leg couplers 50 about the support base 90 allows the user to radially position the legs 40 for optimum stability under varying terrain conditions, when using the shooting bench 10 in the deployed mode.

A proximate end 41 of each the legs 40 attaches in ratcheting fashion to one of the ratcheting leg couplers 50, allowing the user to independently adjust an angle of declination of each the legs 40. A low point 43 of the proximate leg end 41 pivotally attaches by means of a pin 51 to a base 52 of the ratcheting leg coupler 50. A plurality of ratchet teeth 44 are formed in an upper edge 45 of the proximate leg end 41, the plurality of ratchet teeth 44 mechanically interacting with a spring-loaded pawl 54 mounted on an upper bracket 55 of the ratcheting leg coupler 50. Each leg 40 also includes a leg aperture 48 passing through the proximal end 41 of the leg 40, the leg aperture 48 being slightly larger than a cross-section of the table post 28.

Figure 5:
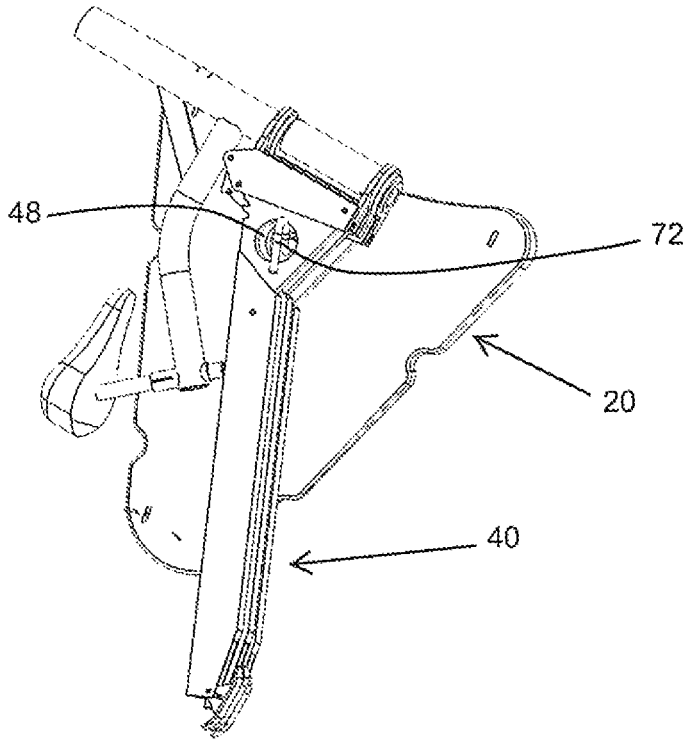
FIG. 5 is a perspective view of one embodiment of the shooting bench in the folded mode.

The user is able to convert the shooting bench 10 from the deployed mode (as shown in FIG. 1) to a folded mode (as shown in FIGS. 5 and 6) by repositioning elements of the shooting bench 10. The user grasps the clamp-rod handle 72 and unscrews the male threaded end 71 of the clamp rod 70 from the deployed-position clamp-rod threaded hole 29A. The user then removes the clamp rod 70 from both the deployed-position clamp-rod threaded hole 29A and the support-post clamp-rod hole 39. Having removed the clamp rod 70, the user is able to remove the table post 28 from the support post aperture 38.

To carryout the conversion to the folded mode the user must also position the plurality of legs 40 within the ratcheting couplers 50 so that each leg 40 is at a matching angle of declination. As shown in FIG. 5, the user can rotate the leg couplers 50 with attached legs 40 around the support base 90 so that the legs 40 are pressed together sandwich-fashion and the leg apertures 48 are in alignment. The user is then able to insert the table post 28 through the aligned leg apertures 48. The user secures the table post 28 in this position by grasping the clamp-rod handle 72 and screwing the male threaded end 71 of the clamp rod 70 into the folded-position clamp-rod threaded hole 29B on the table post 28. The clamp-rod handle 72, having a size larger than the leg apertures 48, is able to secure the table post 28 within the aligned leg apertures 48, with the shooting-bench tabletop 20 on one side of the aligned leg apertures 48 and the clamp-rod handle 72 on another side of the aligned leg apertures 48.

As shown in FIG. 6, the user can use the shooting bench 10 in backpack mode by securing the shoulder straps 80 to the upper surface 21 of the shooting-bench tabletop 20, when the shooting bench 10 is in folded mode. The upper surface 21, preferably having a concave shape, comfortably fits against the user's back when the user loops the shoulder straps 80 onto his or her shoulders to transport the shooting bench 10.

Figure 7:
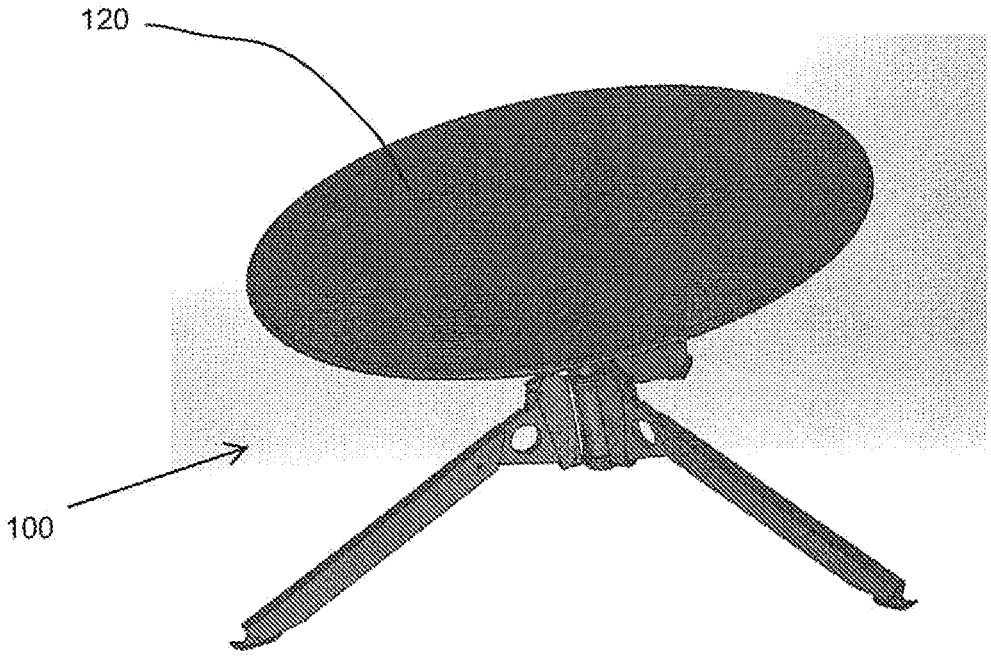
FIG. 7 is a perspective view of one embodiment of the utility table embodiment of the present invention.

FIG. 7 depicts an alternative embodiment of the present invention, in which the portable shooting bench 10 becomes a portable utility table 100 by substituting a utility tabletop 120 for the shooting-bench tabletop 20. The utility tabletop 120 has a size and structure suitable for more standard uses of a table often encountered during activities such as camping, picnicking, and tailgating. In a preferred embodiment, the utility tabletop 120 is round in shape, but other shapes including rectangles, triangles, and ovals are included within the scope of the invention. Various means (not shown) for folding or temporarily disassembling the utility tabletop 120, which allow the utility tabletop 120 to be less bulky when the utility table 100 is in a folded mode, are included within the scope of the invention. Shoulder straps (not shown) also can be affixed to the utility tabletop 120 to allow the utility table 100 to be transported in backpack mode by the user.

Figure 8:
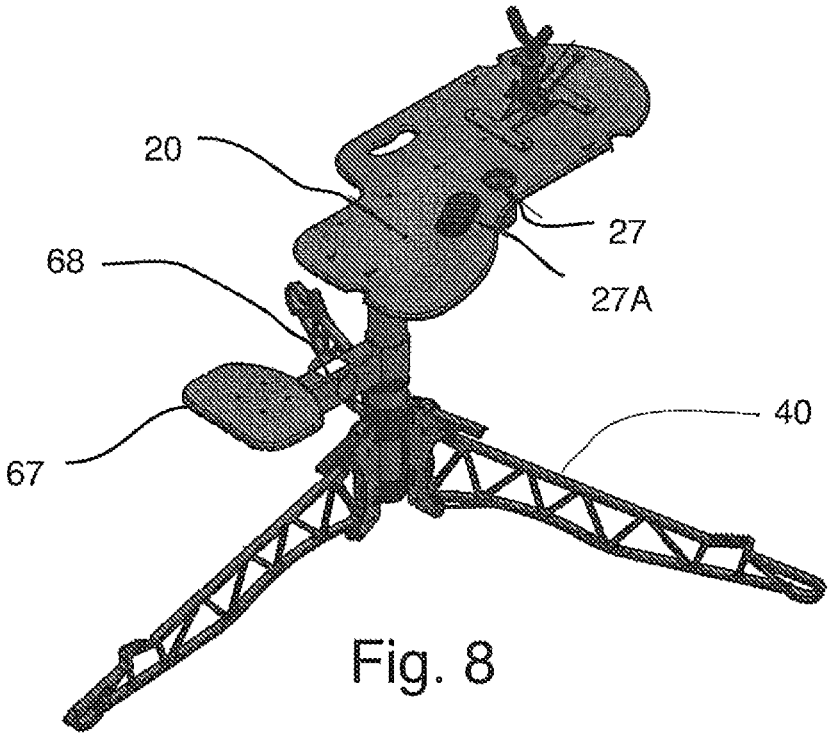
FIG. 8 is a perspective view of an alternate embodiment of the present invention.
Figure 9:
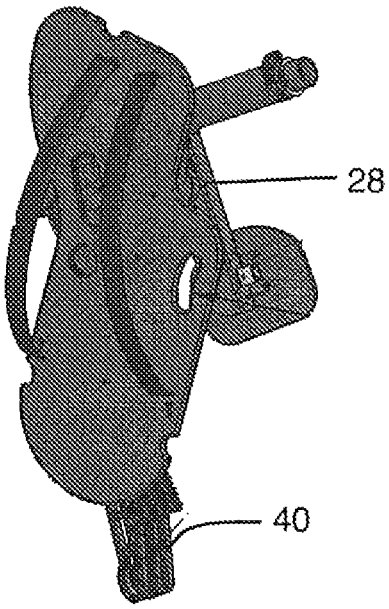
FIG. 9 is a perspective view of an alternate embodiment of the present invention in the folded mode.

Referring now to FIG. 8 and FIG. 9 an alternate embodiment of the shooting bench 10 is shown. Accordingly this embodiment is designed for tactical use and includes slight modifications to some of the features of the shooting bench 10. According to this embodiment, the tabletop 20 includes an ammo tray 27A, the seat 67 is planar and the seat arm 63 includes an aperture 68. The aperture 68 sized to receive the table post 28. Within this embodiment, the aperture 68 replaces the leg aperture 48, wherein the aperture 68 allows for the attachment of the table 20 when the bench 10 is placed into its carry mode.

What is claimed is:

1. A portable shooting bench, the shooting bench comprising:

a table top, the table top having an upper surface, a lower surface, and a table post, the table post extending from the lower surface perpendicular to a length of the table top opposite the upper surface, the table top providing support to a user during operation of a firearm;

a support post, the support post substantially cylindrical and hollow and having an interior, the support post having an upper end and a lower end, the upper end sized to nestedly receive the table post with the interior, the lower end rotatably affixed atop a support base;

the support base cylindrical and providing an attachment point for the rotatable receipt of a plurality of leg couplers;

the leg couplers each rotatably received to the support base, the leg couplers radiating outward from the support post, the leg couplers having a spring-loaded pawl on an upper portion of the leg coupler;

a plurality of legs, the legs each pivotally received within the leg couplers at a proximal end and having a distal end, the proximate end having an upper side, the upper side having a plurality of ratchet teeth, the ratchet teeth sized for engagement with the spring-loaded pawl, and wherein the angle of the legs relative to a ground surface is adjustable through the engagement of the spring-loaded pawl and ratchet teeth, received in the leg couplers; and a seat, the seat affixed to the support post and extending outward, the seat providing support to a user in a seated position when using the device.

2. A shooting bench as in claim 1, wherein the proximate end of the legs includes an aperture, the aperture sized to receive the table post, wherein the device can be disassembled into a folded and stacked position for carrying.

3. A shooting bench as in claim 2, wherein the distal end of each of the plurality of legs includes a pivotally attached foot.

4. A shooting bench as in claim 2, wherein the tabletop is substantially triangular shaped.

5. A shooting bench as in claim 2, wherein the tabletop includes a pair of shoulder straps.

6. A shooting bench as in claim 2, wherein the table top includes an edge, the edge having a notch, the notch sized for receipt of the barrel of the firearm.

7. A shooting bench as in claim 1, wherein the seat includes an aperture, the aperture sized to receive the table post, wherein the device can be disassembled into a folded and stacked position for carrying.

8. A portable shooting bench, the shooting bench comprising:

a table top, the table top having a pair of lateral edges and a rear edge, the lateral edges and rear edge forming a isosceles triangle having an upper surface, a lower surface, and a table post, the table post extending from the lower surface perpendicular to a length of the table top opposite the upper surface, the table top providing support to a user during operation of a firearm;

a support post, the support post substantially cylindrical and hollow and having an interior, the support post having an upper end and a lower end, the upper end sized to nestedly receive the seat post with the interior, the lower end rotatably affixed atop a support base; the support base, the support base cylindrical and providing an attachment point for the rotatable receipt of a plurality of leg couplers;

the leg couplers each rotatably received to the support base, the leg couplers radiating outward from the support post, the leg couplers having a spring-loaded pawl on a upper portion of the leg coupler;

a plurality of legs, the legs each pivotally received within the leg couplers at a proximal end and having a distal end, the proximate end having an upper side and a leg aperture, the upper side having a plurality of ratchet teeth, the ratchet teeth sized for engagement with the spring-loaded pawl, and wherein the angle of the legs relative to a ground surface is adjustable through the engagement of the spring-loaded pawl and ratchet teeth, received in the leg couplers, the leg aperture sized for receipt of the table post; and a seat, the seat affixed to the support post and extending outward, the seat providing support to a user in a seated position when using the device.

9. A shooting bench as in claim 8, wherein the distal end of each of the plurality of legs includes a pivotally attached foot.

10. A shooting bench as in claim 8, wherein the tabletop includes a pair of shoulder straps.

11. A shooting bench as in claim 8, wherein a lateral edge includes a notch, the notch sized for the receipt of a resting firearm.

* * * * *